US008556458B2

(12) United States Patent
Higuchi et al.

(10) Patent No.: US 8,556,458 B2
(45) Date of Patent: Oct. 15, 2013

(54) POWER SOURCE UNIT AND ILLUMINATION DEVICE

(75) Inventors: Kazunari Higuchi, Yokosuka (JP); Takayoshi Moriyama, Yokosuka (JP); Sumio Hashimoto, Yokosuka (JP); Shinichi Kumashiro, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 372 days.

(21) Appl. No.: 12/818,871

(22) Filed: Jun. 18, 2010

(65) Prior Publication Data

US 2010/0321935 A1 Dec. 23, 2010

(30) Foreign Application Priority Data

Jun. 19, 2009 (JP) ..... 2009-146763

(51) Int. Cl.
*F21V 1/00* (2006.01)

(52) U.S. Cl.
USPC ... 362/235; 362/249.02; 362/800; 362/249.1; 362/97.3

(58) Field of Classification Search
USPC ..... 362/249.02, 249.1, 235, 800, 613, 97.3
See application file for complete search history.

(56) References Cited

U.S. PATENT DOCUMENTS

| | | | |
|---|---|---|---|
| 1,683,599 | A | 9/1928 | Percy |
| 3,539,801 | A | 11/1970 | Bobrick |
| 4,807,099 | A | 2/1989 | Zelin |
| 4,963,798 | A | 10/1990 | McDermott |
| 5,580,156 | A | 12/1996 | Suzuki et al. |
| 6,196,707 | B1 | 3/2001 | Deckard |
| 6,367,949 | B1 | 4/2002 | Pederson |
| 6,527,411 | B1 | 3/2003 | Sayers |
| 6,739,734 | B1 | 5/2004 | Hulgan |
| 6,840,654 | B2 | 1/2005 | Guerrieri et al. |
| 6,871,983 | B2 | 3/2005 | Jacob et al. |
| 7,163,315 | B2 | 1/2007 | Chang et al. |
| 7,241,019 | B1 | 7/2007 | Tsai |
| 7,434,955 | B2 | 10/2008 | Vickers |
| 7,566,154 | B2 | 7/2009 | Gloisten |
| 7,604,365 | B2 | 10/2009 | Chang |

(Continued)

FOREIGN PATENT DOCUMENTS

| | | |
|---|---|---|
| DE | 20 2004 001720 | 4/2004 |
| EP | 1 722 158 | 11/2006 |

(Continued)

OTHER PUBLICATIONS

English Abstract of JP 2006-172895 published Jun. 29, 2006.

(Continued)

*Primary Examiner* — Anabel Ton
(74) *Attorney, Agent, or Firm* — DLA Piper LLP (US)

(57) ABSTRACT

According to one embodiment, a power source unit includes a substrate and a reflective body. The substrate includes a plurality of light-emitting elements mounted thereon. The reflective body includes a plurality of incident openings each corresponding to one of the plurality of light-emitting elements, an output opening to which light that has passed through the incident opening is output, and a plurality of reflective surfaces that expand from the incident opening toward the output opening. Reflective surfaces included in the plurality of reflective surfaces and positioned on an outermost side are provided to be adjacent to one another, and an angle is set so as to prevent reflective light of light emitted from the light-emitting elements from traveling toward an outer side in a reflective surface formed on the outer side.

2 Claims, 9 Drawing Sheets

(56) References Cited

U.S. PATENT DOCUMENTS

| | | | |
|---|---|---|---|
| 7,676,915 | B2 | 3/2010 | Ter-Hovhannissian |
| 7,794,114 | B2 | 9/2010 | Medendorp |
| 8,025,424 | B2 | 9/2011 | Mondloch |
| 2002/0093820 | A1 | 7/2002 | Pederson |
| 2003/0081419 | A1 | 5/2003 | Jacob |
| 2003/0137838 | A1 | 7/2003 | Rizkin et al. |
| 2003/0156410 | A1 | 8/2003 | Ter-Hovhannisian |
| 2004/0208210 | A1 | 10/2004 | Inoguchi |
| 2005/0128744 | A1 | 6/2005 | You |
| 2005/0254241 | A1 | 11/2005 | Harwood |
| 2006/0139942 | A1 | 6/2006 | Pond et al. |
| 2007/0035951 | A1 | 2/2007 | Tseng |
| 2007/0062032 | A1 | 3/2007 | Ter-Hovhannissian |
| 2007/0097693 | A1 | 5/2007 | Klose |
| 2007/0121328 | A1 | 5/2007 | Mondloch |
| 2008/0043466 | A1 | 2/2008 | Chakmakjian |
| 2008/0074889 | A1 | 3/2008 | Gloisten et al. |
| 2008/0219000 | A1 | 9/2008 | Fan |
| 2010/0181916 | A1 | 7/2010 | Mondloch |

FOREIGN PATENT DOCUMENTS

| | | |
|---|---|---|
| EP | 1 818 607 | 8/2007 |
| EP | 2 034 234 | 3/2009 |
| GB | 2 365 962 | 2/2002 |
| JP | 2006-172895 | 6/2006 |
| JP | 2008-047541 | 2/2008 |
| JP | 2008-186776 | 8/2008 |
| JP | 2008-204692 | 9/2008 |
| JP | 2009-009826 | 1/2009 |
| JP | 2009-064637 | 3/2009 |

OTHER PUBLICATIONS

Machine Translation of JP 2006-172895 published Jun. 29, 2006.
English Abstract of JP 2008-186776 published Aug. 14, 2008.
Machine Translation of JP 2008-186776 published Aug. 14, 2008.
English Abstract of JP 2008-204692 published Sep. 4, 2008.
Machine Translation of JP 2008-204692 published Sep. 4, 2008.
Chinese First Examination Notification issued Dec. 25, 2009 in CN 2008 101355481.
European Search Report dated Nov. 6, 2008 issued in EP 08163696.
File History of U.S. Appl. No. 12/717,154.
File History of U.S. Appl. No. 12/470,223.
File History of U.S. Appl. No. 12/582,721.
File History of U.S. Appl. No. 12/757,623.
File History of U.S. Appl. No. 12/757,664.
File History of U.S. Appl. No. 12/757,596.
File History of U.S. Appl. No. 12/205,460.
Extended European Search Report issued in EP 09006842 dated Aug. 10, 2010.
English Language Translation of DE 20 2004 001720 publised Apr. 8, 2004.
English Abstract of EP 1,722,158 published Nov. 15, 2006.
Machine Translation of EP 1,722,158 published Nov. 15, 2006.
Extended Search Report issued in EP 10166378.9 on Oct. 6, 2010.
File History of related U.S. Appl. No. 12/757,596.
File History of related U.S. Appl. No. 12/470,223.
File History of related U.S. Appl. No. 12/727,623.
File History of related U.S. Appl. No. 12/757,664.
File History of related U.S. Appl. No. 12/757,623.
European Search Report issued in EP 09013238 on Nov. 21, 2011.
Supplementary European Search Report issued in EP 10002139.3, dated Apr. 27, 2012.
File History of related U.S. Appl. No. 12/717,154.
File History of related U.S. Appl. No. 12/582,721.
Chinese Office Action issued in CN 200910206611mailed Jul. 26, 2012.
English Language Translation of Chinese Office Action issued in CN 200910206611mailed Jul. 26, 2012.
Chinese Office Action issued in CN 201010207332.9 dated Aug. 31, 2012.
English Language Translation of Chinese Office Action issued in CN 201010207332.9 dated Aug. 31, 2012.
Japanese Office Action issued in JP 2009-052118 on Nov. 7, 2012.
English Language Translation of Japanese Office Action issued in JP 2009-052118 on Nov. 7, 2012.
English Language Abstract of JP 2008-047541 published Feb. 28, 2008.
English Language Translation of JP 2008-047541 published Feb. 28, 2008.
Chinese Office Action issued in CN 201010129123.7 on Sep. 28, 2012.
English Language Translation of Chinese Office Action issued in CN 201010129123.7 on Sep. 28, 2012.
Partial File History of related U.S. Appl. No. 12/717,154.
Partial File History of related U.S. Appl. No. 12/582,721.
English Language Abstract of JP 2009-064637 published Mar. 26, 2009.
Machine English Language Translation of JP 2009-064637 published Mar. 26, 2009.
English Language Abstract of JP 2009-009826 published Jan. 15, 2009.
Machine English Language Translation of JP 2009-009826 published Jan. 15, 2009.

POWER SOURCE UNIT AND ILLUMINATION DEVICE

CROSS-REFERENCE TO RELATED APPLICATIONS

This application is based upon and claims the benefit of priority from Japanese Patent Application No. 2009-146763, filed Jun. 19, 2009; the entire contents of which are incorporated herein by reference.

FIELD

Embodiments described herein relate generally to a light source unit using a light-emitting element, such as an LED, and an illumination device using the light source unit.

BACKGROUND

Recently, illumination devices comprising light-emitting elements (e.g., LEDs) mounted on a substrate and using the light-emitting elements as light source have been developed. An example of such a device is a downlight that uses an LED as light source. In general, the downlight uses either a reflective plate or a lens to control the light emitted from the LED. Downlights have to provide more than a certain degree of illumination at a position immediately below. The use of LED downlilghts is desired because they provide a wide total luminous flux.

DETAILED DESCRIPTION

In general, according to one embodiment, a power source unit includes a substrate and a reflective body. The substrate includes a plurality of light-emitting elements mounted thereon. The reflective body includes a plurality of incident openings each corresponding to one of said plurality of light-emitting elements, an output opening to which light that has passed through the incident opening is output, and a plurality of reflective surfaces that expand from the incident opening toward the output opening. Reflective surfaces included in said plurality of reflective surfaces and positioned on an outermost side are provided to be adjacent to one another, and an angle is set so as to prevent reflective light of light emitted from the light-emitting elements from traveling toward an outer side in a reflective surface formed on the outer side.

Hereinafter, a light source unit and an illumination device according to the present embodiment will be described with reference to FIGS. 1-7.

Figure 1:
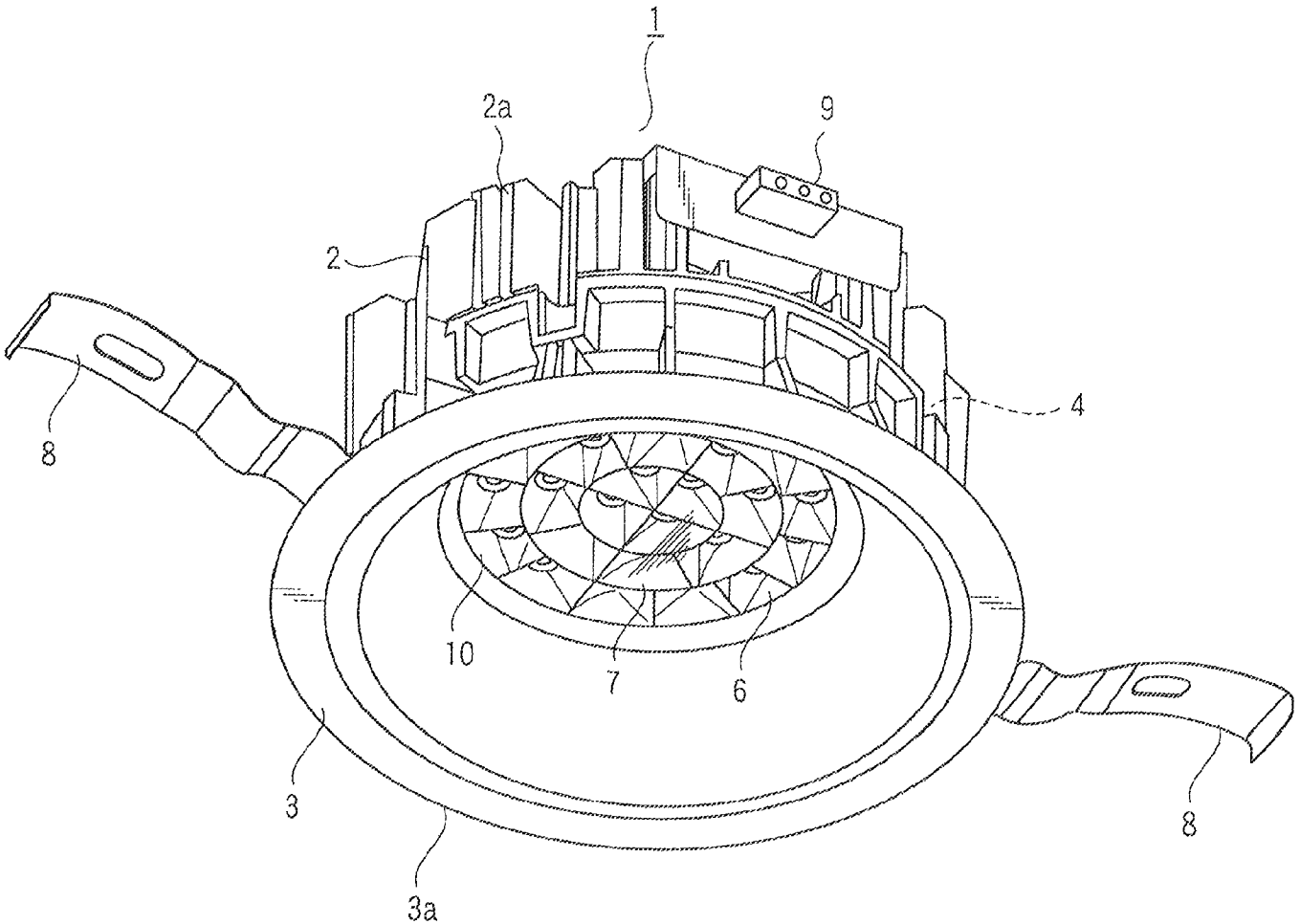
FIG. 1 is a perspective view of an illumination device according to the embodiment.
Figure 2:
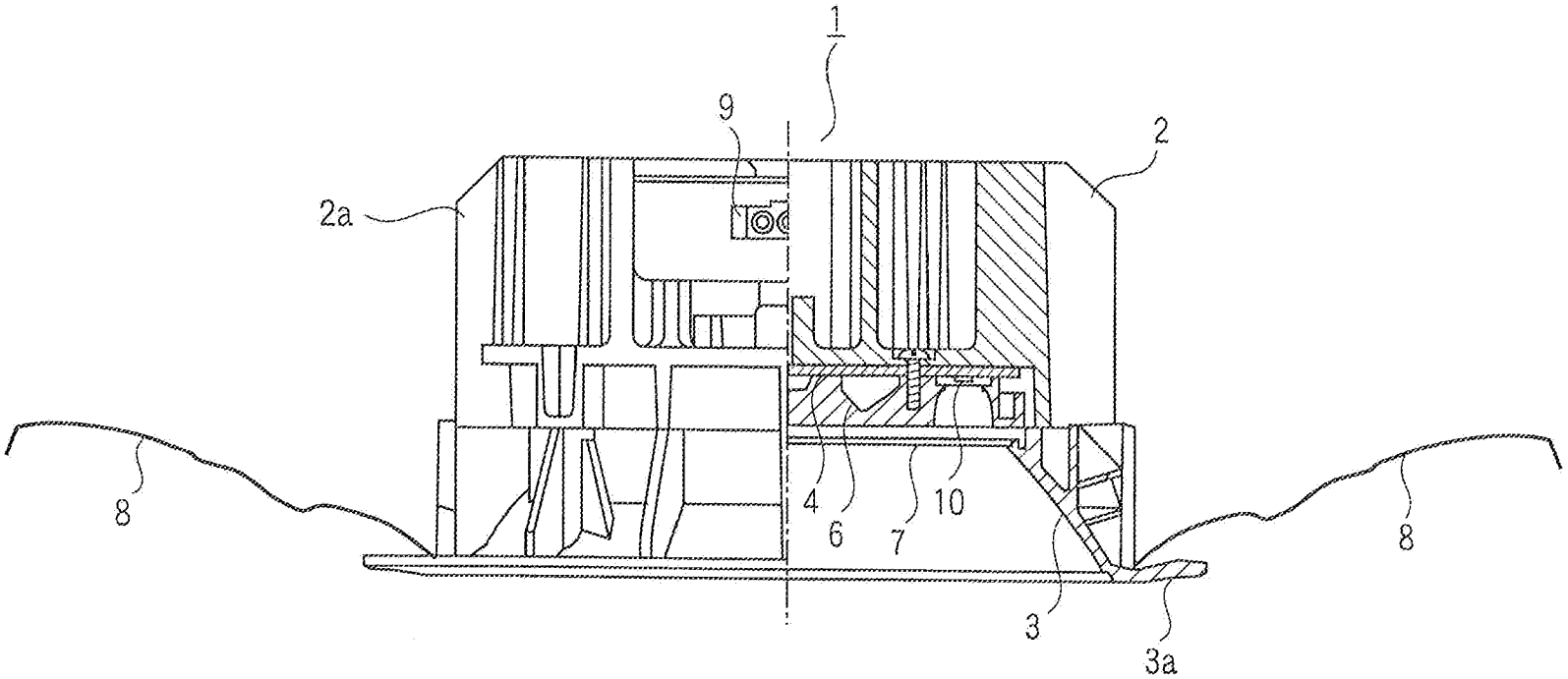
FIG. 2 is a front view illustrating the same portion in cross section.

As shown in FIGS. 1 and 2, a downlight body 1 includes a cylindrical body 2 having thermal transfer properties, a cosmetic frame 3 attached to the cylindrical body 2, a substrate 4 attached to the inside of the cylindrical body 2 and including an LED 10 mounted thereon as a light-emitting element that is a light source, a reflective body 6, and a translucent cover 4 arranged forward of the reflective body 6. Further, a power input connector 9 is provided on an upper outer surface of the cylindrical body 2, and a pair of attachment plate springs 8 is attached to the cosmetic frame 3. Further, the substrate 4 and the reflective body 6 form a power source unit.

The cylindrical body 2 is formed of an aluminum die-cast material having favorable thermal transfer properties, and its outer surface is baking-finished by a melamine resin coating material. Further, a plurality of thermal radiation fins 2*a* are formed on the outer surface of the cylindrical body 2, so as to extend in the longitudinal direction.

The cosmetic frame 3 is formed of an ABS resin in white in an approximately umbrella shape. A circular flange 3*a* is formed at a tapered opening end of the cosmetic frame 3, and the other end of the cosmetic frame 3 is attached to the cylindrical body 2.

The substrate 4 is formed in an approximately round plate shape. A plurality of LEDs 10, which become light source, are mounted on the surface side by surface mounting. More specifically, the number of the LEDs 10 is 26 in total: 4 in a central portion; 8 along the portion surrounding the central portion; and 14 along the outermost circumference. The substrate 4 is formed of an approximately round flat plate made of a glass epoxy resin, and is thermally bonded to the cylindrical body 2. When an insulating material is adopted as the material for the substrate 4, a ceramic material or a synthetic resin material having relatively favorable thermal radiation properties and excellent durability may be adopted. When a metal is adopted as the material for the substrate 4, a material having favorable thermal transfer properties and excellent thermal radiation properties, such as aluminum, should preferably be adopted.

On the surface side of the substrate 4, there is provided a reflective body 6 formed of a white polycarbonate, an ASA resin, or the like. The reflective body 6 individually controls distribution of light emitted from each of the LEDs 10, and functions to irradiate the light efficiently. The power input connector 9 is electrically connected to the LED 10 via a terminal provided on the substrate 4, and is provided so as to protrude in an outer circumferential direction of the cylindrical body 2.

Figure 3:
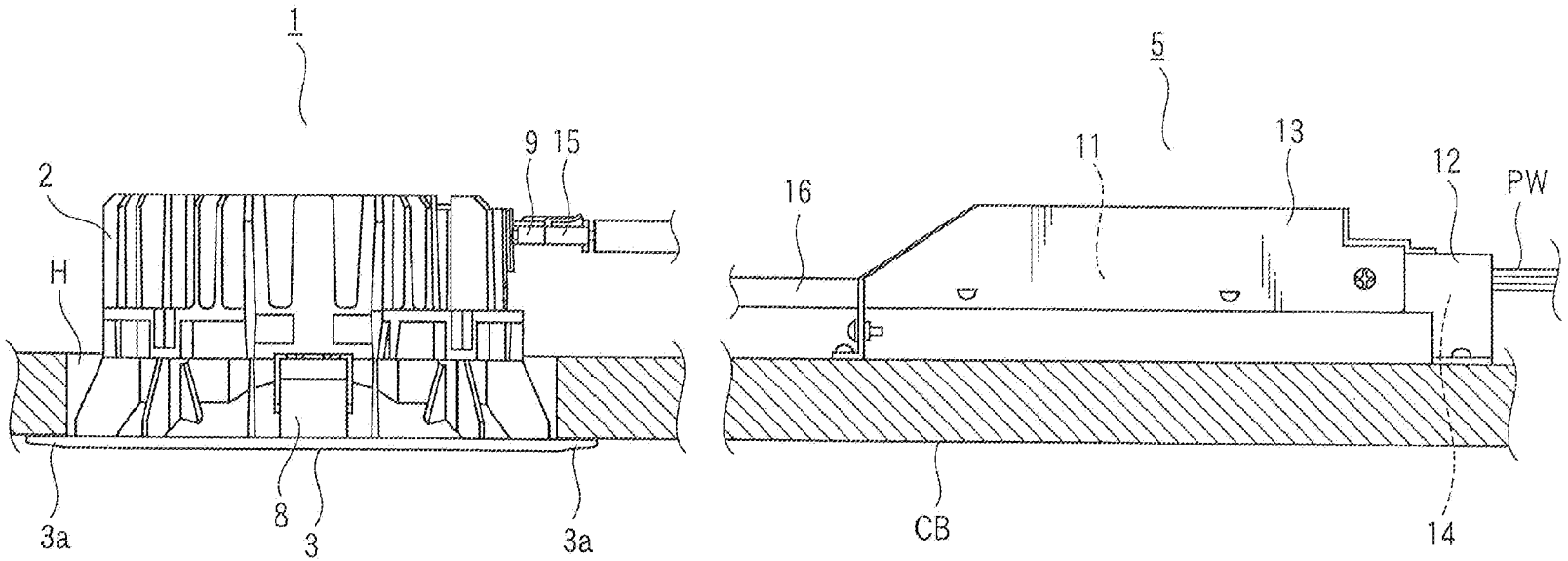
FIG. 3 is a side view of the state in which the illumination device is installed to a ceiling surface.

FIG. 3 shows a state in which the downlight body 1 as an illumination device and the power source unit 5 are installed to a ceiling surface and connected to each other. In the present embodiment, an illumination device is configured by the connection of the downlight body 1 and the power source unit 5.

The power source unit 5 is configured to supply power to the light source of the downlight body 1, and cause the lighting circuit to control lighting of the light source, and has a function of a direct current power source that outputs a predetermined direct current voltage upon receipt of a commercial power source. The power source unit 5 has an approximately ship shape, and includes a case body 12 to which the power circuit 11 is attached, a cover member 13 covering the case body, a power source terminal mount 14 connected to a power wire PW (including an earth wire) for a commercial power source, and a supply connector 15 connected to a power input connector 9 of the downlight body 1.

In installing such an illumination device, the power wire PW arranged at the back of a ceiling CB is pulled out from an embedding hole H formed in the ceiling CB and is connected to the power terminal mount 14 of the power source unit 5, and then the supply connector 15 is connected to the power input connector 9 of the downlight body 1. Next, the power source unit 5 is inserted from the embedding hole H, and is arranged at the back of the ceiling CB. Next, a pair of attachment plate springs 8 of the downlight body 1 is operated by both hands so as to be pressed down against the elastic power, and are inserted from the embedding hole H while supporting the downlight body 1. As the downlight body 1 is inserted into the embedding hole H, the downlight body 1 is pressed up by releasing the hands. Thereby, the attachment plate springs 8 return to the outer side direction and abut against the back surface of the ceiling CB. The elastic power causes the downlight body 1 to be pulled upward; and the flange 3*a* of the cosmetic frame 3 to be pressed against the circumferential edge of the embedding hole H, and the downlight body 1 to be arranged on the surface of the ceiling CB.

Figure 4:
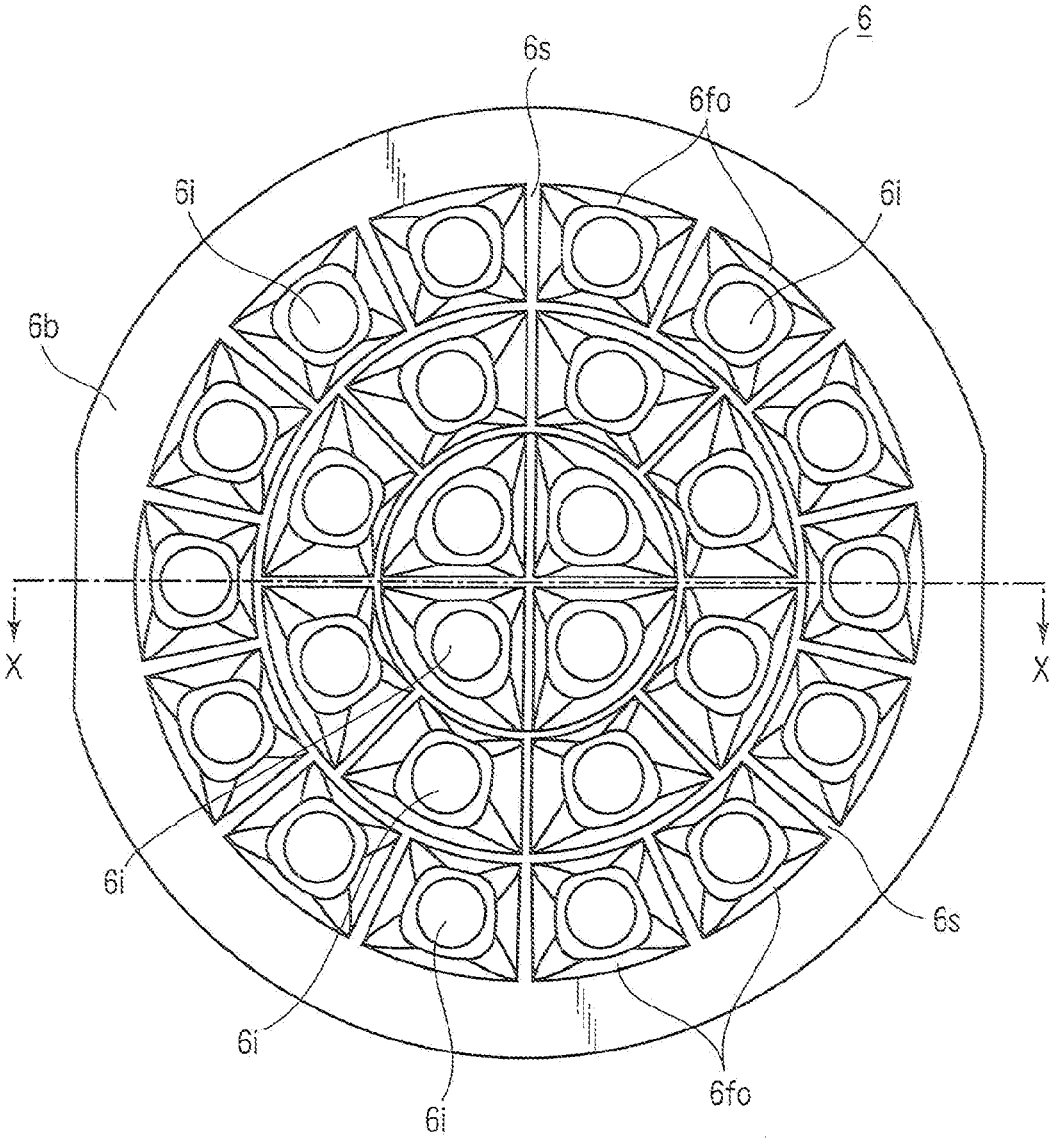
FIG. 4 is a plan view of the reflective body.
Figure 5:
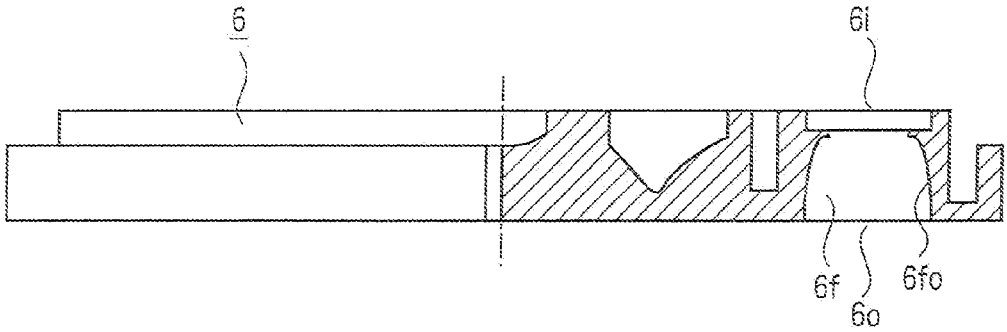
FIG. 5 is a front view illustrating the reflective body of FIG. 4 in partial cross section cut along line X-X.

Next, the reflective body 6 will be described with reference to FIGS. 4 and 5. The reflective body 6 has a disc shape, and a plurality of incident openings 6*i* are formed by ridgeline portions of each of the partition walls 6*s*. More specifically, 26 incident openings 6*i* are formed so as to correspond to the LEDs 10.

Figure 6:
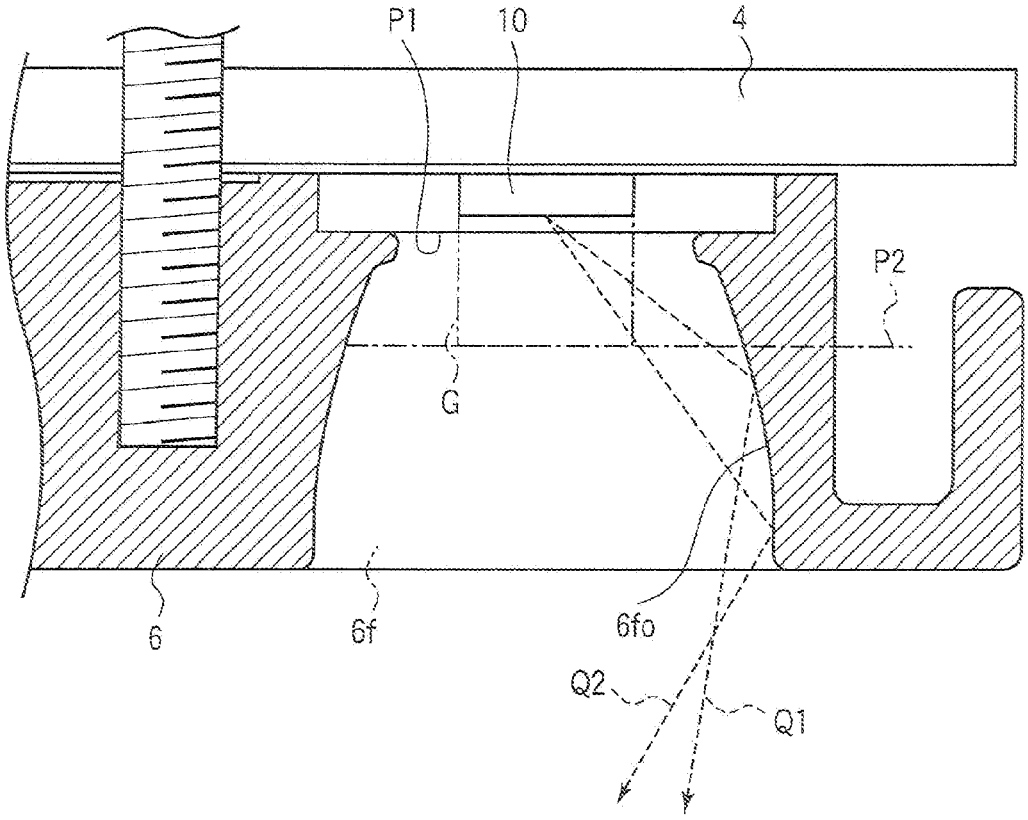
FIG. 6 is an explanatory diagram illustrating the path of light by exploding the reflective surface of the reflective body.

What is meant by "correspond to the LEDs 10" is that the position of the incident opening 6*i* is P1 in FIG. 6 when the LED 10 is denoted by the solid line as shown in FIG. 6, and the position of the incident opening 6*i* is P2 in FIG. 6 when the LED 10 is denoted by the two-dot chain line G.

First, a ring-like outer circumferential edge portion 6*b* is formed along the outer circumference of the reflective body 6, 4 incident openings 6*i* are formed in the central portion, 8 incident openings 6*i* are formed along the portion surrounding the central portion, and 14 incident openings 6*i* are formed along the outermost circumference further surrounding the portion surrounding the central portion. Further, the output opening 6*o* is formed such that the light that has passed through the incident opening 6*i* is output therefrom, and each of the partition walls 6*s* extending from the incident opening 6*i* to the output opening 6*o* forms an approximately saucer-shaped reflective surface 6*f*. The reflective surface 6*f* expands from the incident opening 6*i* toward the output opening 6*o*, that is, toward the ridgeline portion, and each of the reflective surfaces 6*f* forms one incident openings 6*i*, that is, a unit reflective surface 6*f*.

The shape of the reflective surfaces 6*f* varies between the 4 provided on the innermost circumference, the 8 provided on the in-between circumference, and the 14 provided on the outermost circumference.

As will be described below, the 14 reflective surfaces 6*f* provided along the outermost circumference in continuity so as to be adjacent to one another are configured such that the angle of a reflective inner surface 6*fo* that is the unit reflective surface 6*f* and is formed on the outer circumference side is set to a predetermined angle. With this structure, the light emitted from the LED 10 and falling directly on the reflective inner surface 6*fo* is not reflected outward of the cylindrical body 2, with reference to a vertical line to the substrate surface.

Next, the operation of an illumination device with the above-described configuration will be described. When the power unit 5 is energized, a power is supplied to the substrate 4, and the LED 10 emits light. Much of the light emitted from the LEDs 10 directly transmits through the translucent cover 7 and is irradiated forward, and some of the light is reflected by the reflective surfaces 6*f* of the reflective body 6, is controlled as to distribution, and transmits through the translucent cover 7, and is irradiated forward. In this case, since the reflective surface 6*f* reflects light from the LEDs 10, the entire reflective surface 6*f* shines.

In this case, as shown in FIG. 6, the reflective inner surface 6*fo* formed on the outer circumference side of the reflective surface 6*f* of the outermost circumference has a great gradient, and is formed in the shape of a curved surface that is close to an approximately vertical state. Accordingly, the light emitted from the LEDs 10, reflected by the reflective inner surface 6*fo*, and radiated outward travels toward the inside, instead of traveling toward the outside the reflective surface 6*f*, as shown by the arrows Q1, Q2. It is thereby possible to suppress production of a dark portion due to difference in brightness, without affecting the inner surface, for example, of the cosmetic frame 3. Basically, the light reflected by the reflective inner surface 6*fo* and emitted outward travels toward the inside of the reflective surface 6*f*, but production of light that travels toward the outside of the reflective surface 6*f* due to multiple reflection or light leakage is permitted, as a matter of course.

Figure 7:
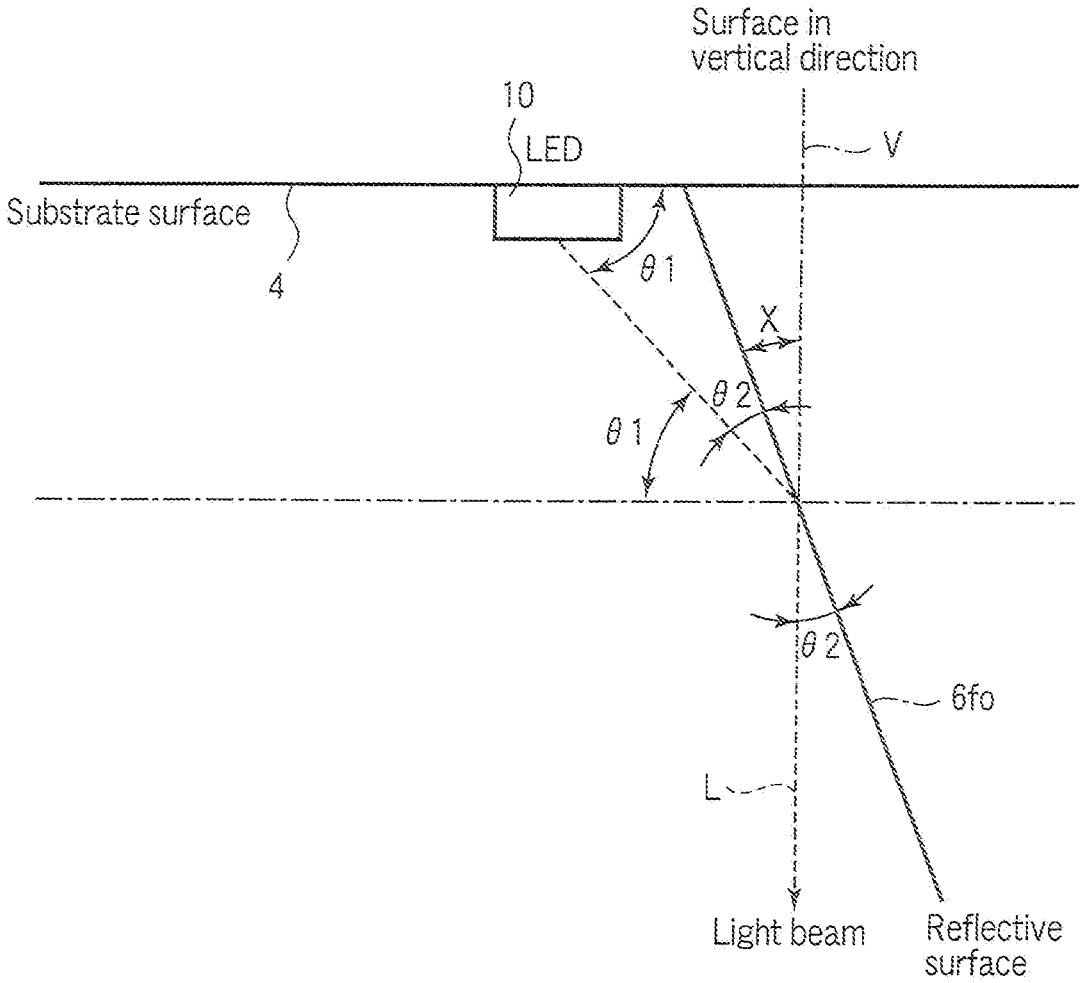
FIG. 7 is a schematic explanatory diagram illustrating the set angle formed by reflective surfaces of the reflective body.

Next, the design setting of the reflective inner surface 6*fo* will be described with reference to FIG. 7. Assume that the LEDs 10 are arranged on four surfaces of the substrate, and there is a reflective inner surface 6*fo* inclined obliquely downward from the four surfaces of the substrate. Further, assume that light is emitted from the LEDs 10, reflected by the reflective inner surface 6*fo*, and travels downward in the vertical direction. The direction of the light is the critical point of whether the light travels toward the outside of the reflective inner surface 6*fo* or toward the inside thereof. Accordingly, by obtaining angle x formed by the surface C in the vertical direction with respect to the 4 surfaces of the substrate and the reflective inner surface 6*fo*, it is possible to prevent the output light from traveling toward the outside. That is, it is possible by setting the reflective inner surface 6*fo* such that angle x becomes small.

More specifically, angle x can be obtained by the following:

$$x=90-\theta_1-\theta_2 \quad (1)$$

$$\theta_2=(180-(\theta_1+90))/2 \quad (2)$$

where the angle formed by the four surfaces of the substrate and the light beam is θ1 and one of the inner angles of a triangle formed by the reflective surfaces 6*fo*, the four surfaces of the substrate, and the light beam L is θ2.

Substituting Equation 2 in Equation 1 yields the following:

$$x=45-\theta_1/2 \quad (3)$$

Thus, by setting the reflective inner surface 6*fo* such that the relationship $x \leq 45-\theta_1/2$ is satisfied, the output light can be prevented from traveling toward the outside.

A description will be given of a ceiling installation type downlight 101, a comparative example to be compared with the present embodiment.

The downlight 101 comprises a cylindrical body 102 having thermal transfer properties, a cosmetic frame 103 attached to the cylindrical body 102, a substrate 104 also attached to the cylindrical body 102 and including an LED 110 as a light-emitting element mounted thereon, a power source unit 105 contained in the cylindrical body 102, a reflective body 106, and a translucent cover 107 provided forward of the reflective body 106. A pair of attachment plate springs 108 is attached to the cosmetic frame 103, and the substrate 104 and the reflective body 106 form a power source unit.

The cosmetic frame 103 is formed of an ABS resin in white in an approximately umbrella shape. A circular flange 103*a* is formed at a tapered opening end of the cosmetic frame 103, and the other end of the cosmetic frame 103 is attached to the cylindrical body 102. On a surface side of the substrate 104, a plurality of LEDs 110, which become light source, are mounted by surface mounting. On the surface side of the substrate 104, there is provided the reflective body 106, which is formed of a white polycarbonate, an ASA resin, or the like. The reflective body 106 controls distribution of light emitted from the LED, and functions to irradiate the light effectively.

Figure 9:
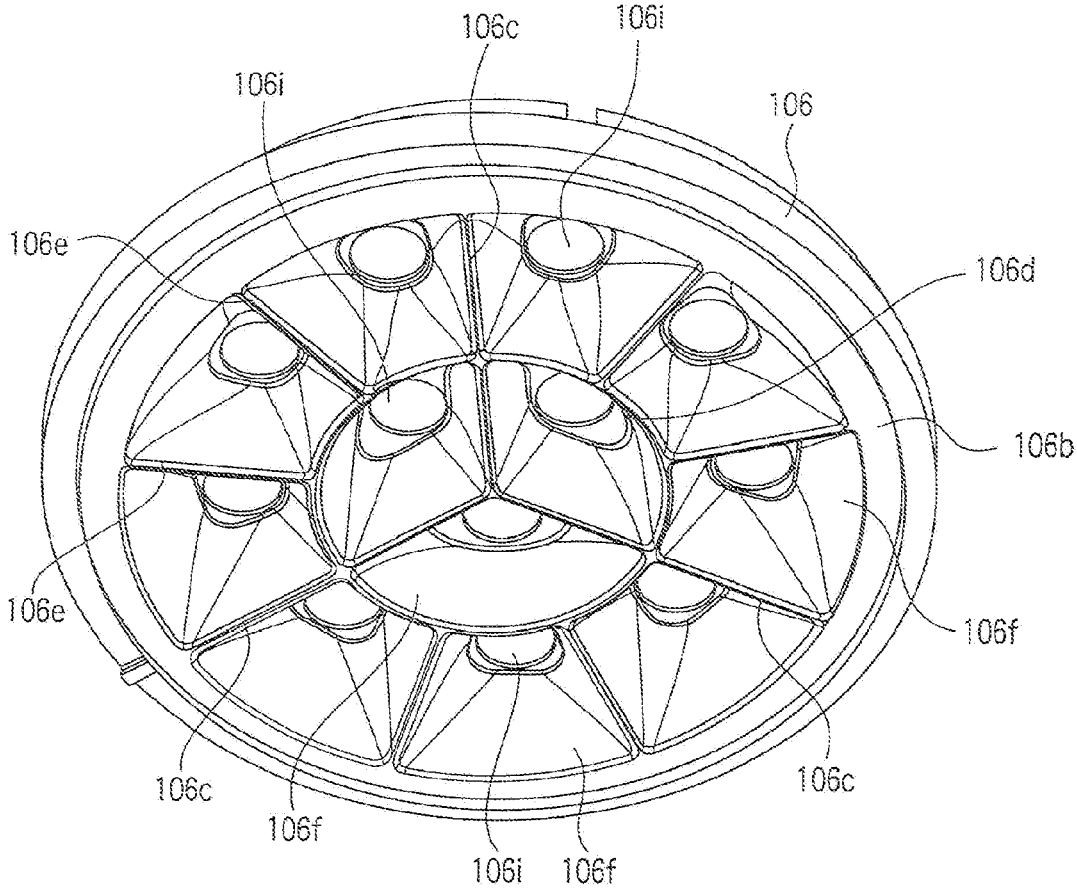
FIG. 9 is a perspective view illustrating the reflective body.

As shown in FIG. 9, the reflective body 106 has a disc shape, and a plurality of incident openings 106*i* are formed by partition ridgeline portions. A ring-shaped outer circumferential edge portion 106*b* is formed along the outer circumference of the reflective body 106, and radial partition walls 106*c* are radially formed from the central portion toward the outer circumferential portion, that is, toward the outer circumferential edge portion 106*b* at intervals of approximately 120 degrees. Further, between the central portion and the outer circumferential edge portion 106*b*, there is provided a round inner circumferential partition wall 106*d*, so as to divide the radial partition wall 106*c* into equal halves.

Further, two divisional partition walls 106*e* extend from an outer wall of the inner circumferential wall 106*d* positioned between the radial peripheral walls 106*c*, toward the outer circumferential edge portion 106*b*.

Further, the reflective body 106 expands from the incident opening 106*i* toward the output opening 106*o*, that is, toward the ridgeline portion, such that the partition wall corresponding to each of the incident openings 106*i*, that is, the reflective surface 106*f* formed by the radial partition wall 106*c*, the inner circumferential partition wall 106*d*, and the divisional partition wall 106*e* has an approximately saucer shape, and each incident opening 106*i* forms the reflective surface 106*f*.

According to this configuration, when the power source unit 105 is energized, a lighting circuit is operated, a power is supplied to the substrate 104, and the LED 110 emits light. Much of the light emitted from the LEDs 110 directly transmits through the translucent cover 107 and is irradiated forward, and some of the light is reflected by the reflective surface 106*f* of the reflective body 106 and controlled as to distribution, transmits through the translucent cover 107, and is radiated forward.

Figure 8:
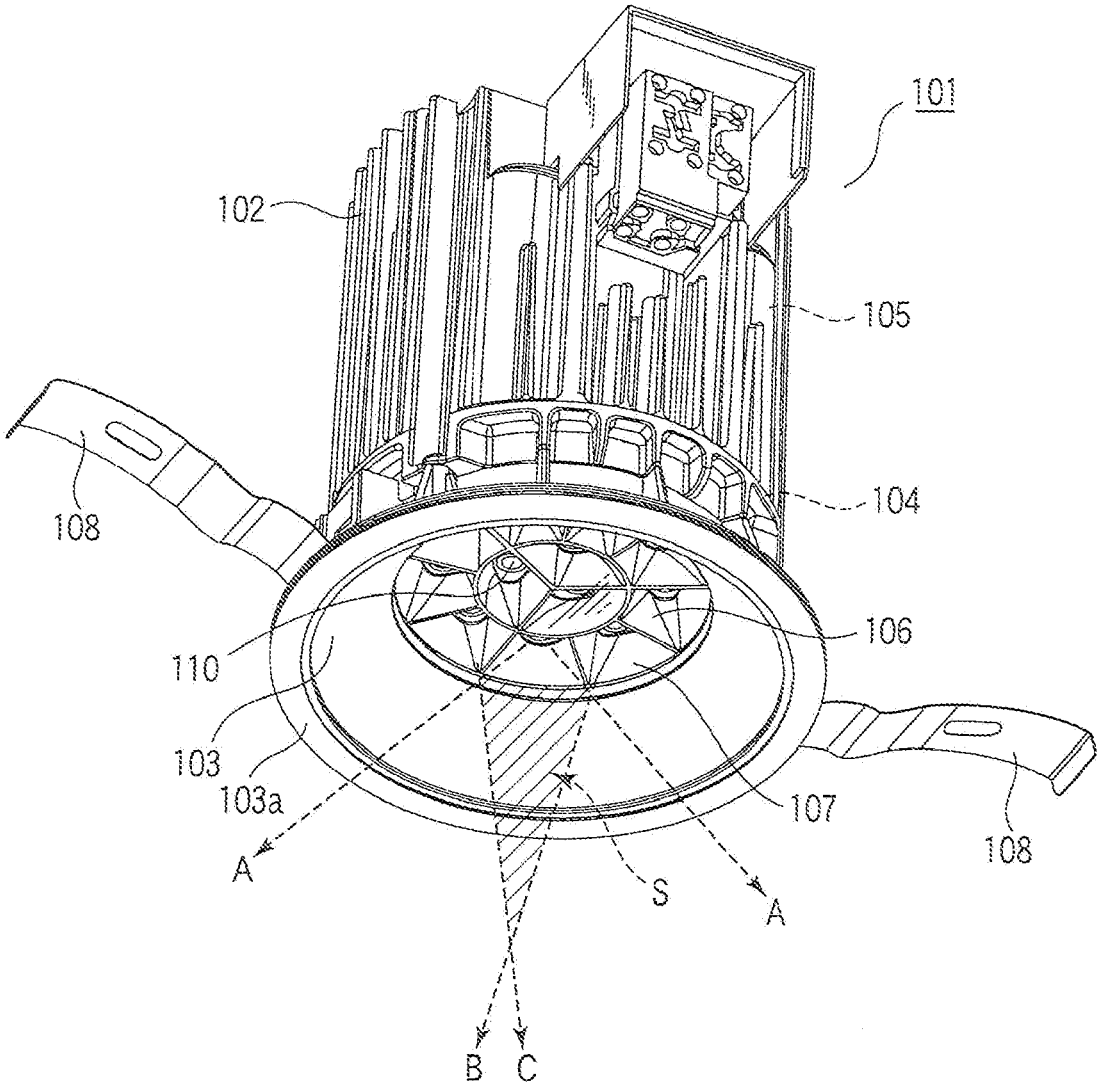
FIG. 8 is a perspective view illustrating an illumination device according to a comparative example.

When the inner surface of the cosmetic frame 103 or the downlight 101 is arranged against a wall as shown in FIG. 8, for example, however, a shadow-like relatively dark portion S is produced on the wall surface, for example, by difference in brightness, and inconsistency is caused in light distribution.

Figure 10:
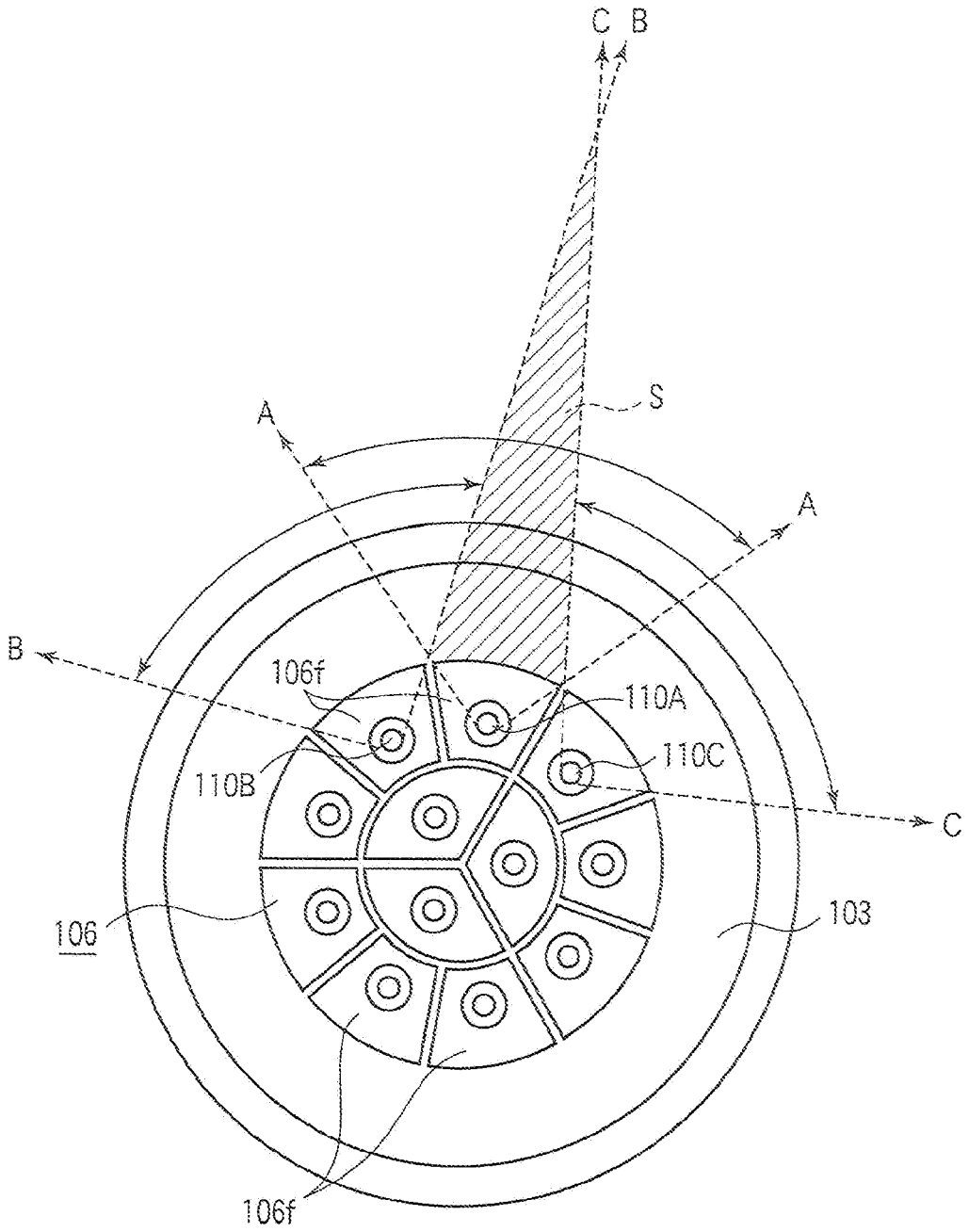
FIG. 10 is a schematic plan view illustrating the reflective body.

Referring to the plan view of FIG. 10, the light emitted from the LED 110A arranged on the outer circumferential side is controlled mainly by the reflective surface 106*f* as to distribution, and is irradiated within the irradiation range of A-A as shown. Further, the light emitted from the LEDs 110B, 110C on both sides arranged adjacent thereto is irradiated within the irradiation ranges of B-B and C-C as shown. Accordingly, the range of the irradiation range A-A with which the irradiation range B-B or C-C overlaps is illuminated relatively brightly, and the region (dark portion S) illuminated only by the light emitted mainly from the LED 110A is relatively dark.

As described above, compared with the downlight 101 shown in FIG. 8, a light source unit and an illumination device according to the present embodiment are effective in improving quality of light distribution and suppressing production of a dark portion due to the brightness difference caused in the inner surface, for example, of the cosmetic frame 3. That is, light uniformity is obtained in illumination surfaces located at a side of the illumination device.

That is light uniformity is obtained in the area directly under the illumination device.

The set angle of the reflective surface 6*f* on the inner side is greater than the set angle of the outermost reflective surface 6*f*. With this structure, improved light uniformity is obtained in the area directly under the illumination device. In this manner, light uniformity is improved on surfaces located immediately under the illuminating device and uniform brightness is obtained on surfaces located at a side of the illuminating device, by setting the reflective inner surface 6*fo* of the outermost reflective surface 6*f* at a predetermined angle, determining the set angle of the outermost reflective layer 6*f* to be a small value and determining the set angle on the reflecting surface 6*f* on the inner side to be a comparatively large value.

This is valid in a case where the LED mounting density increases as the output of the light source increases, the number of LEDs in use increases, and adjacent LEDs become close. Further, the shading angle can be made greater by setting of the angle of the reflective inner surface 6*fo*, and thereby glare can be reduced.

The present embodiment is not limited to the above-described configuration, and may be embodied with various modifications within the scope of the embodiment. For example, the light source unit should preferably be used as a downlight, but is applicable to spotlights or various types of illumination devices used indoor or outdoor.

In the present embodiment and the embodiments that will be described below, the technical meaning and interpretation of the terms will be following. The substrate may be formed of a metal, such as aluminum, or a synthetic resin, such as a glass epoxy resin, for example, its shape may be rectangular, circular, polygon, or the like, and there is no particular limitation on its size either. Similarly, the shape of the reflective body may be rectangular, circular, polygon, or the like, and there is no particular limitation on its size either.

The light-emitting element is a solid light-emitting element, such as an LED, and there is no limitation on the number of light-emitting elements to be mounted. Further, mounting of the light-emitting elements should preferably be by surface mounting or chip-on-board method, but the method of mounting is not particularly limited by features of the embodiment.

The light-emitting elements and the incident openings opposed thereto are not limited to the case where one light-emitting element is opposed to one incident opening. For example, two light-emitting elements may be opposed. In that case, two light-emitting elements are opposed to one incident opening.

That the reflective surfaces provided outermost are provided to be adjacent to one another means that the reflective surfaces are adjacent to one another geometrically.

The unit reflective surface is used as a term on which individual reflective surfaces are focused. Further, that the angle is set such that the reflective light of the light emitted from the light-emitting element does not travel toward the outside means basic technical matters, and production of light traveling toward the outside of the reflective surface due to multiple reflection or light leakage, for example, is permitted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power source unit, comprising:

a substrate including a plurality of light-emitting elements mounted thereon; and a reflective body including:

a plurality of incident openings each corresponding to one of said plurality of light-emitting elements;

an output opening to which light that has passed through each incident opening is output; and a plurality of reflective surfaces that expand from each incident opening toward each output opening, reflective surfaces included in said plurality of reflective surfaces and positioned on an outermost side are provided to be adjacent to one another, and the reflective body satisfying the following relationship:

$$x \leq 45 - \theta_1/2,$$

where an angle formed by a reflective surface formed on an outer side and a surface in a direction perpendicular to a substrate surface is x, and an angle formed by a light beam emitted from the light-emitting elements and the surface substrate is $\theta_1$.

2. An illumination device, comprising:

a device body;

a substrate arranged in the device body including a plurality of light-emitting elements mounted thereon; and a reflective body arranged in the device body including:

a plurality of incident openings each corresponding to one of said plurality of light-emitting elements;

an output opening to which light that has passed through each incident opening is output; and a plurality of reflective surfaces that expand from each incident opening toward each output opening, reflective surfaces included in said plurality of reflective surfaces and positioned on an outermost side are provided to be adjacent to one another, and an angle is set so as to prevent reflective light of light emitted from the light-emitting elements from traveling toward an outer side in a reflective surface formed on the outer side.

* * * * *